US008286437B2

(12) United States Patent
Sanders et al.

(10) Patent No.: US 8,286,437 B2
(45) Date of Patent: Oct. 16, 2012

(54) TRANSPORT REFRIGERATION SYSTEM WITH PREDICTIVE REFRIGERATION

(75) Inventors: Russell L. Sanders, Minnetonka, MN (US); Ashok Muralidhar, Eagan, MN (US); Timothy A. Walker, Plymouth, MN (US)

(73) Assignee: Thermo King Corporation, Minneapolis, MN (US)

( * ) Notice: Subject to any disclaimer, the term of this patent is extended or adjusted under 35 U.S.C. 154(b) by 346 days.

(21) Appl. No.: 12/827,831

(22) Filed: Jun. 30, 2010

(65) Prior Publication Data

US 2012/0000212 A1 Jan. 5, 2012

(51) Int. Cl.
*F25D 25/00* (2006.01)

(52) U.S. Cl. ..... 62/62; 62/234

(58) Field of Classification Search ..... 62/62, 80, 62/234, 231, 133, 239, 243, 244; 340/585, 340/586, 436; 342/457, 450; 701/200, 207, 701/213; 236/51
See application file for complete search history.

(56) References Cited

U.S. PATENT DOCUMENTS

| | | | | |
|---|---|---|---|---|
| 4,455,096 | A * | 6/1984 | Brandstedt | 374/170 |
| 5,186,015 | A * | 2/1993 | Roehrich et al. | 62/133 |
| 5,197,666 | A | 3/1993 | Wedekind | |
| 5,424,720 | A * | 6/1995 | Kirkpatrick | 340/585 |
| 5,999,091 | A | 12/1999 | Wortham | |
| 6,027,031 | A | 2/2000 | Reason et al. | |
| 6,298,911 | B1 | 10/2001 | Volz et al. | |
| 6,549,130 | B1 * | 4/2003 | Joao | 340/539.14 |
| 6,564,147 | B2 * | 5/2003 | Chen et al. | 701/36 |
| 6,679,071 | B1 * | 1/2004 | Storey et al. | 62/126 |
| 6,952,181 | B2 * | 10/2005 | Karr et al. | 342/457 |
| 7,091,825 | B2 * | 8/2006 | Sahai | 340/5.72 |
| 7,156,168 | B2 | 1/2007 | Gutbrod et al. | |
| 7,253,731 | B2 * | 8/2007 | Joao | 340/539.13 |
| 7,310,576 | B1 | 12/2007 | Letang | |
| 7,343,244 | B2 * | 3/2008 | Flick | 701/484 |

(Continued)

FOREIGN PATENT DOCUMENTS

DE 102004032621 2/2006

(Continued)

OTHER PUBLICATIONS

International Search Report dated Feb. 23, 2012 of PCT/US2011/042172, filed Jun. 28, 2011, 5 pages.

(Continued)

*Primary Examiner* — Mohammad Ali
(74) *Attorney, Agent, or Firm* — Michael Best & Friedrich LLP

(57) ABSTRACT

A transport unit including a container defining a cargo space. The transport unit includes position detection apparatus coupled to the container, and adapted to determine a geographic location of the container and to generate a signal indicative of the geographic location. The transport unit also includes a refrigeration system in communication with the cargo space, and a control system including route data that defines a plurality of potential destinations of the container. The control system is programmed to predict a container route defined by at least two potential destinations of the container based on the geographic location and the route data, and to determine a proximity of the container relative to at least one potential destination of the route. The control system is in communication with the refrigeration system to control the refrigeration system based on the proximity of the container relative to the at least one potential destination.

25 Claims, 3 Drawing Sheets

U.S. PATENT DOCUMENTS

| | | | | |
|---|---|---|---|---|
| 7,385,529 | B2 | 6/2008 | Hersh et al. | |
| 7,455,225 | B1 | 11/2008 | Hadfield et al. | |
| 2005/0021224 | A1* | 1/2005 | Gray | 701/200 |
| 2005/0187693 | A1* | 8/2005 | Bate et al. | 701/70 |
| 2005/0248444 | A1* | 11/2005 | Joao | 340/426.13 |
| 2007/0008119 | A1 | 1/2007 | Pohle et al. | |
| 2007/0040647 | A1 | 2/2007 | Pohle et al. | |
| 2008/0009988 | A1 | 1/2008 | Metzger | |
| 2008/0228514 | A1 | 9/2008 | Robinson et al. | |
| 2009/0272132 | A1 | 11/2009 | Rusignuolo et al. | |

FOREIGN PATENT DOCUMENTS

| | | | |
|---|---|---|---|
| EP | 0908337 | | 4/1999 |
| EP | 0974742 | | 1/2000 |
| JP | 8175150 | | 7/1996 |
| JP | 09318207 | A | 12/1997 |
| JP | 10100815 | | 4/1998 |
| JP | 11296795 | | 10/1999 |
| JP | 2002039659 | | 2/2002 |
| JP | 2005295160 | | 10/2005 |
| JP | 2006012160 | | 1/2006 |
| JP | 2007168750 | | 7/2007 |
| KR | 2007016305 | | 2/2007 |
| KR | 1020070016305 | A | 2/2007 |

OTHER PUBLICATIONS

Written Opinion dated Feb. 23, 2012 of PCT/US2011/042172, filed Jun. 28, 2011, 4 pages.

* cited by examiner

TRANSPORT REFRIGERATION SYSTEM WITH PREDICTIVE REFRIGERATION

BACKGROUND

The present invention relates to a transport refrigeration system, and more particularly, the present invention relates to a transport unit including a control system for controlling the transport refrigeration system.

Generally, transport vehicles or carriers are used to transport temperature sensitive cargo in transport containers to one or more destinations. The cargo is transported, stored, or otherwise supported within a cargo space of the transport container, and is maintained at predetermined conditions within the cargo space using a transport refrigeration system during transportation to preserve the quality of the cargo.

Often, the refrigeration system is controlled by a temperature control unit. In some transport containers, the temperature control unit includes a simple thermostat that turns the refrigeration unit on and off based on a single environmental condition (i.e., the desired temperature of the cargo space, or the setpoint temperature) to regulate the condition of the cargo space. An operator sets the thermostat to the desired setpoint temperature, and the thermostat controls the refrigeration unit to maintain the temperature of the space near the setpoint temperature. These existing thermostats are manually adjusted when a different setpoint temperature is desired.

Transport refrigeration systems are typically setup based on the geographical area in which they are used. Within these geographical areas, transport vehicles deliver goods to one or more destinations. En route to these destinations, the temperature control unit conditions the cargo space based on the desired setpoint temperature, and the condition of the goods is often monitored to obtain information regarding the quality of the goods.

SUMMARY

In one construction, the invention provides a transport unit including a container defining a cargo space for supporting cargo. The transport unit includes position detection apparatus that is coupled to the container, and that is adapted to determine a geographic location of the container and to generate a signal indicative of the geographic location. The transport unit also includes a refrigeration system in communication with the cargo space to condition the cargo space, and a control system including route data that defines a plurality of potential destinations of the container. The control system is in communication with the position detection apparatus to receive the signal indicative of the geographic location of the container. The control system is programmed to predict a route of the container based on the geographic location and the route data. The route is defined by at least two potential destinations of the container. The control system is further programmed to determine a proximity of the container relative to at least one potential destination of the predicted route. The control system is in communication with the refrigeration system to control the refrigeration system based on the proximity of the container relative to the at least one potential destination.

In another construction, the invention provides a method of operating a transport unit including a refrigeration system. The method includes supporting cargo in a container of the transport unit, detecting a geographic location of the container, and generating a signal indicative of the geographic location. The method also includes providing route data that defines a plurality of potential destinations of the container, and predicting a route of the container based on the geographic location and the route data. The route includes at least two potential destinations of the container. The method further includes determining a proximity of the container relative to at least one of the potential destinations of the route, and operating the refrigeration system based on the proximity of the container relative to the at least one potential destination.

In yet another construction, the invention provides a method of transporting goods along route using a transport unit including a refrigeration system. The method includes detecting a geographic location of a container traveling a route, generating a signal indicative of the geographic location, providing route data defining a plurality of potential destinations of the container, and predicting a route of the container based on the geographic location and the route data. The predicted route is defined by at least two potential destinations of the container. The method also includes determining a proximity of the container relative to a first potential destination of the container, operating the refrigeration system in a first mode in response to the container being in close proximity to the first potential destination, at least one of delivering and receiving cargo relative to the container at the first potential destination, determining a proximity of the container relative to a second potential destination of the container, operating the refrigeration system in a second mode in response to the container being in close proximity to the second potential destination, and at least one of delivering and receiving cargo relative to the container at the second potential destination.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
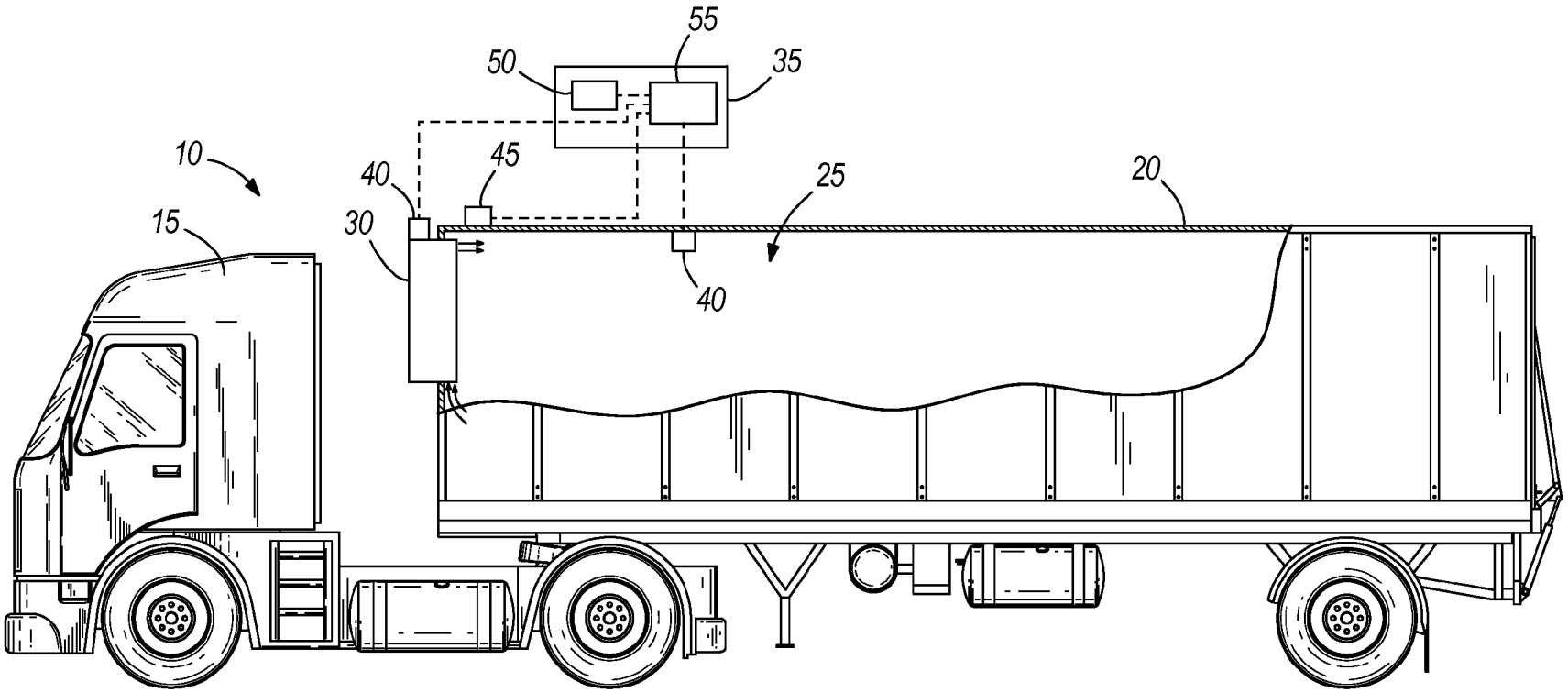
FIG. 1 is a side view of a transport carrier including a container that has a transport refrigeration system according to the present invention.

FIG. 1 shows a transport unit 10 that is suitable for storing and transporting perishable cargo (e.g., food, agricultural goods, medical supplies, etc.) maintained at predetermined environmental conditions. The illustrated transport unit 10 includes a tractor 15 that is coupled to a trailer or container 20. The container 20 defines a cargo space 25 for shipping the cargo in a tractor-trailer combination. The cargo space 25 may include one or more compartments for storage and transportation of cargo. In some constructions, the transport unit 10 can include a straight truck, van, or another similar transport vehicle that transports environmentally-sensitive goods. In other constructions, the transport unit 10 can include a free-standing shipping container (e.g., ocean shipping containers, railroad containers, airline containers, etc.). Hereinafter, the term "transport unit" shall be used to represent all such containers and trailers, and shall not be construed to limit the invention's application solely to a trailer in a tractor-trailer combination.

The transport unit 10 also includes a transport refrigeration system 30 in communication with the cargo space 25, and a control system 35 that is in communication with the refrigeration system 30. The transport refrigeration system 30 maintains the cargo space 30 at desired or predetermined environment conditions (e.g., temperature, humidity, light etc.) during transportation and storage of cargo to preserve the quality of the cargo. Although not shown, the transport refrigeration system 30 includes various refrigeration system components, such as one or more compressors, a condenser, one or more evaporators fluidly interconnected for circulating a heat transfer fluid or refrigerant, and one or more fans for circulating air in a manner well understood by those having ordinary skill in the art. The transport refrigeration system 30 may also include other components (e.g., a receiver, an accumulator, an expansion valve, etc.). The components of the transport refrigeration system 30 will not be described in great detail as many variations known to those having ordinary skill in the art may be employed.

In some constructions, the transport refrigeration system 30 may include sub-systems (e.g., a temperature control sub-system, a humidifier sub-system, a lighting sub-system, etc.) that regulate certain environmental characteristics of the cargo space 25. Generally, each sub-system performs one or more functions that regulate environmental conditions of the cargo space 25.

The transport refrigeration system 30 is operable in various modes to condition the cargo according to the predetermined environment conditions for the cargo space 25. Generally, the transport refrigeration system 30 includes a null mode in which the transport refrigeration system 30 does not operate to cool or heat the cargo space 25, or to defrost the evaporator. The transport refrigeration system also includes a normal refrigeration mode in which the transport refrigeration system 30 cools or refrigerates the cargo space 25 according to the predetermined environment conditions. The transport refrigeration system 30 also is operable in a supercool mode, a heat mode, a defrost mode, and a diagnostic mode. As is well understood, the supercool mode corresponds to a relatively quick pull-down of the temperature of the cargo space 25 via the transport refrigeration system 30, for example, when cargo is first loaded into the container 20. In the heat mode, the transport refrigeration system 30 is operable to heat the cargo space 25 based on the predetermined environment conditions of the cargo space 25. The transport refrigeration system 30 is operable in the defrost mode to remove frost accumulated on coils of the evaporator during the supercool mode and the normal refrigeration mode. The transport refrigeration system 30 is operable in the diagnostic mode to determine and/or diagnose the state or condition of one or more components of the refrigeration system 30 and the control system 35. For example, the transport refrigeration system 30 can be operated in the diagnostic mode prior to transporting goods using the transport unit 10 (e.g., an automated pre-trip diagnostic mode).

The control system 35 can be located anywhere on the container 20, and includes sensor apparatus 40. The sensor apparatus 40 can be located anywhere on the transport unit 10, and is in communication with the transport refrigeration system 30 to detect operating conditions of the transport refrigeration system 30 and to generate signals indicative of the operating conditions. The operating conditions monitored by the sensor apparatus 40 include one or more of an evaporator temperature, refrigerant pressure, air temperature (e.g., air temperature of the environment, air temperature of the cargo space 25), door status, fuel level, oil level, an engine speed or revolutions per minute (RPM), humidity, an amount of carbon dioxide in the cargo space 25, an amount of oxygen in the cargo space 25, barometric pressure, and engine temperature. The operating conditions also can include one or more of a fan speed, frost buildup on the evaporator coil, and refrigerant temperature. The operating conditions monitored by the sensor apparatus 40 may also include other operational characteristics of the transport refrigeration system 30.

The sensor apparatus 40 also is in communication with the cargo space 25 to measure environment conditions inside the cargo space 25 and to generate signals indicative of the environment conditions. The environment conditions monitored by the sensor apparatus 40 can include, but are not limited to, temperature, humidity, light, container door openings and closings, and air circulation within the cargo space 25. Generally, the sensor apparatus 40 includes multiple sensors that measure the operating conditions and the environment conditions.

The control system 35 also includes position detection apparatus 45, a database 50, and a controller 55. The position detection apparatus 45 is coupled to the container 20 and is in electrical communication with the controller 55. The position detection apparatus 45 also is in communication with one or more geographic position systems to determine a geographic location of the container 20 and to generate a signal indicative of the geographic location. For example, the position detection apparatus 45 may be in communication with a satellite-based system (e.g., global positioning system or GPS), antenna-based systems (e.g., 3G/4G networks), or hotspot-based systems (e.g., WiFi, Bluetooth, radio frequency, etc.). The position detection apparatus 45 can determine the geographic location of the container 20 periodically or continuously via one or more systems capable of determining the geographic location of the container 20.

The database 50 is in communication with the controller 55 and includes memory for storing instructions and information that may be executed or used by the controller 55. The memory can include any suitable medium (e.g., cloud computing, machine-readable medium such as a magnetic disk or optical drive, etc., non-volatile memory, etc.) for storing the instructions and information. In some constructions, the database 50 may be remote from the controller 55 such that the controller 55 is in communication with the database 50 via wireless access modules (e.g., radio frequency signal, infrared signal, satellite link, cellular telephone, etc.).

The database 50 includes route data associated with the container 20. Generally, the route data defines possible routes taken by the container 20 from a start location (e.g., a warehouse, a distribution center, a farm, etc.) to two or more destinations (e.g., manufacturing/production facilities, warehouses, retail stores, consumers, etc.) along a supply chain. The destinations may also include a geographic area (e.g., desert, mountain range, etc.) through which the transport unit 10 will or may travel.

Figure 3:
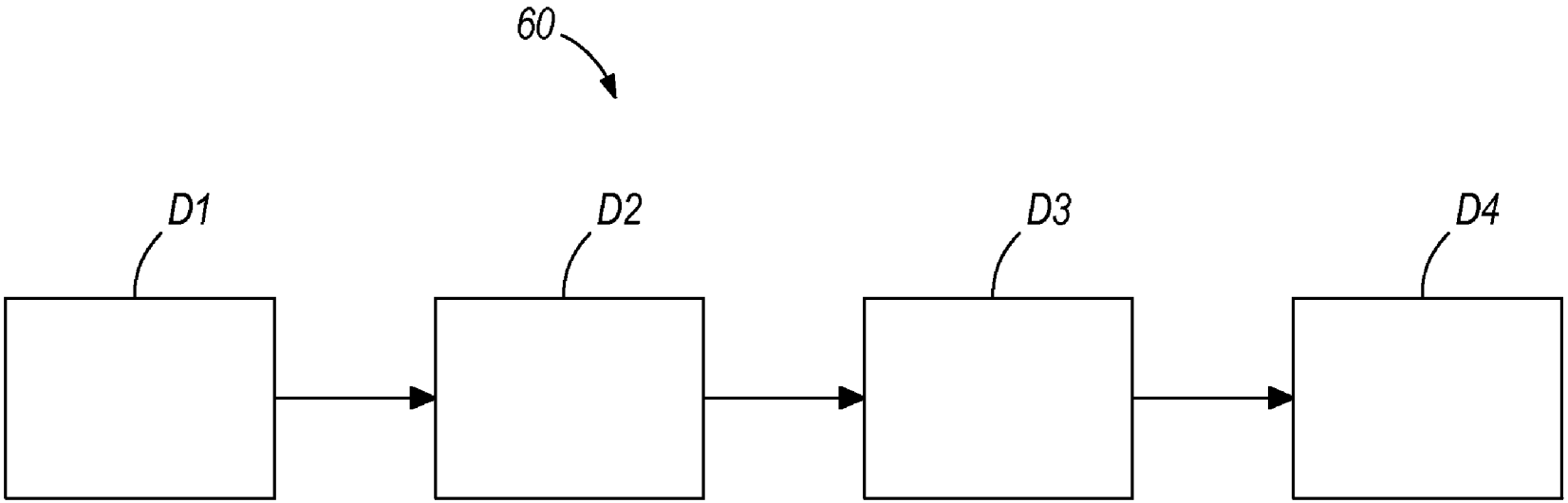
FIG. 3 is a schematic view of an exemplary route of the container.

The destinations of the container 20 can include the start location, one or more intermediate destinations, and an end destination, with each destination being a stopping point along the route (e.g., one route is a "trip" taken by the container 20 from a start location to an end destination). FIG. 3 shows an exemplary route 60 of the container 20. The illustrated route 60 is a point-to-point route including four potential destinations D1, D2, D3, D4 of the container 20. Other routes may include fewer or more than four potential destinations. In the illustrated construction, the destination D1 is a start location or start destination (e.g., a distribution warehouse), the destinations D2, D3 are intermediate destinations, and the destination D4 is an end destination (e.g., a retail store, a warehouse, etc.) that is different from the destination D1. In other constructions, the destination D4 may be same as the destination D1 (e.g., the end destination also may be the start destination). The end destination (e.g., destination D4) also may be the same as or different from an intermediate destination (e.g., destinations D2, D3) between the starting location and the end destination. In other words, the route may be a point-to-point route between the starting location and the end destination as illustrated in FIG. 3. Alternatively, the route may be a loop route between the starting location and the end destination such that the end destination and the start destination are the same destination. Further, the route may be a modified loop route such that the end destination also is one or more intermediate destinations along the route. Other routes are also possible and considered herein.

The route data defines either or both predetermined destinations and historical destinations of the container 20. The predetermined destinations and the historical destinations are programmed into the control system 35. The predetermined destinations are known destinations or stop locations for the container 20. The historical destinations are expected or likely destinations or stop locations that are associated with the container 20 or other containers that previously traversed similar routes. For example, the historical destinations can be based on previous routes taken by the container 20 or other containers. Generally, the predetermined destinations and the historical destinations are defined as potential destinations of the container 20. Each route of the container 20 is defined by at least two potential destinations.

The database 50 also includes rules or operating parameters for the transport refrigeration system 30 that are associated with the route data, and actions or implementation procedures for controlling the transport refrigeration system 30 based on the operating parameters. The operating parameters govern or control operation of the transport refrigeration system 30 based on the geographic position of the container 20 and the route data. In other words, operation of the transport refrigeration system 30 using a particular operating parameter is at least partly determined by the proximity of the container 20 to a predetermined destination or a historical destination stored in the database 50. For example the container 20 may be in close proximity to the destination when the container is within a quarter-mile of that destination. Close proximity of the container 20 relative to the destination may also include other distances (e.g., one-half mile, one mile, five miles, etc.). Generally, the proximity of the container 20 relative to the destination can be any desired predetermined distance. The distance at which the container 20 is in close proximity to the destination defines a boundary relative to that destination. Operation of the refrigeration system 30 is at least partly based on where the container 20 is located relative to the boundary.

Generally, the operating parameters relate to an operational state of the transport refrigeration system 30. For example, the operating parameters may relate to operating the transport refrigeration system 30 in one or more of the null mode, the normal refrigeration mode, the supercool mode, the heat mode, the defrost mode, and the diagnostic mode based on the geographic position of the container 20 and the route data. In some constructions, the transport refrigeration system 30 can be operated in one of these modes independent of (without regard to) the type of cargo being shipped.

The operating parameters also can relate to an operational state of various refrigeration components of the transport refrigeration system 30 (e.g., fan(s), compressor(s), valve(s), etc.). For example, the operating parameters may relate to operating the components at different speeds (e.g., different fan speeds, different compressor speeds or capacities, etc.) or adjusting the position of one or more components (e.g., valves,) based on the geographic position of the container 20 and the route data. Other operating parameters tied to the geographic position of the container 20 and the route data are also possible and considered herein.

For example, the database 50 can include a fuel system operating parameter associated with a fuel level threshold (e.g., 20 percent fuel level of the fuel system, 10 percent fuel level, etc). at which a fuel alarm is activated for a fuel system of an engine of the transport refrigeration system 30. The fuel system operating parameter at which the transport refrigeration system 30 operates is based on the geographic location of the transport unit 10 and the route data associated with the container 20. The fuel system operating parameter can vary depending on the location of the transport unit 10.

As another example, the database 50 can include a frost avoidance operating parameter associated with the transport refrigeration system 30 to regulate the temperature of the cargo space 25 based on the geographic location and the route data. Depending on the proximity of the transport unit 10 to a destination, the transport refrigeration system 30 can decrease the temperature of the cargo space 25 to a predetermined minimum temperature prior to the transport unit 10 reaching the destination so that when the transport unit 10 is stopped at the destination, the evaporator of the transport refrigeration system 30 can be warmed to prevent condensation from forming or freezing on the evaporator coil. In other words, the control system 35 takes advantage of the planned or predicted destination to maintain the cargo space 25 within the predetermined temperature range while avoiding frost formation on the evaporator.

The operating parameters discussed above are only exemplary. Other operating parameters (e.g., fan speed, compressor speed or capacity, valve position(s), engine load of the transport refrigeration system 30, electrical power consumed by the transport refrigeration system 30, etc.) associated with the container 20 and the transport refrigeration system 30 are also possible and considered herein. Furthermore, the operating parameters of the transport refrigeration system 30 encompass operation of the refrigeration system 30 in one of the null mode, the supercool mode, the normal refrigeration mode, the defrost mode, and the diagnostic mode.

The operating parameters can be stored in the database 50 locally (e.g., by an operator of the container 20) or remotely as predetermined operating parameters. The operating parameters also may be accumulated operating parameters determined based on data accumulated from the cargo space 25 and the transport refrigeration system 30 by the control system 35. The accumulated data includes the operating conditions and the environment conditions sensed or detected by the sensor apparatus 40, and other container data that is available to the control system 35. Additional operating parameters of the transport refrigeration system 30 also can be established using the accumulated data.

The implementation procedures can be stored in the database 50 locally (e.g., by the operator) or remotely as predetermined implementation procedures. The implementation procedures also may be determined based on data accumulated by the control system 35 from the cargo space 25 and the transport refrigeration system 30. The implementation procedures correspond to the actions available to the control system 35 for controlling the transport refrigeration system 30 based on the geographic position of the container 20, the route data, and the operating parameters. For example, the implementation procedures include selectively varying operation of the transport refrigeration system 30 between the null mode, the normal refrigeration mode, the supercool mode, the heat mode, the defrost mode, and the diagnostic mode based on the operating parameters of the transport refrigeration system 30. The implementation procedures also include selectively varying refrigeration component settings of the transport refrigeration system 30 (e.g., fan speed adjustment, compressor speed or capacity adjustment, valve position adjustment, fuel level alarm adjustment, adjustment of temperature within the cargo space 25, etc.).

The controller 55 is in communication with the database 50 locally or remotely to carry out or initiate the appropriate implementation procedure based on the route data and the geographic location of the container 20 to condition the cargo space 25 based on the associated operating parameter(s). More specifically, the controller 55 is in communication with the sensor apparatus 40 to receive the signals indicative of the operating conditions of the transport refrigeration system 30 and the environment conditions of the cargo space 25 and the ambient environment, the position detection apparatus 45 to receive the signals indicative of the geographic location of the container 20, and the transport refrigeration system 30 to control operation of the transport refrigeration system 30. The controller 55 communicates with various components of the transport refrigeration system 30 (e.g., the compressor(s), the fans, valves, and/or other components) to control the conditions within the cargo space 25 as desired.

The control system 35 controls and operates the refrigeration system 30 using route-based control based on the geographic location of the container 20 using the operating parameters available to the controller 55. During transport, the implementation procedures are selectively carried out based on the operating parameters determined by the geographic position of the container 20 and the route data available within the database 50 to appropriately control the refrigeration system 30. In transit, the geographic position or location of the container 20 is determined by the position detection apparatus 45, and the location of the container 20 is then communicated to the controller 55. The controller 55 predicts a route of the container 20 based on the geographic position of the container 20 and the potential destinations stored in the database 50. The predicted route may include predetermined destinations, expected or historical destinations, or a combination of predetermined destinations and historical destinations. The controller 55 also determines the proximity of the container 20 to at least one potential destination of the predicted route, and determines the appropriate operating parameter or operating mode and the corresponding implementation procedure(s) for operating the transport refrigeration system 30 based on the proximity of the container 20 to the at least one potential destination.

With reference to FIG. 3, prior to the container 20 being in transport to the destination D1, the refrigeration system 30 can be operated in the diagnostic mode to determine the state of one or more of the components of the refrigeration system 30 and/or the control system 35. Based on the state of the diagnosed components, the controller 55 can determine one or more operating parameters for the container 20 en route to the destination D1.

When the controller 55 determines that the container 20 is in transport to the destination D1 based on the signal from the position detection apparatus 45 and the route data available to the controller 55, the control system 35 can initiate the supercool mode of the transport refrigeration system 30 to quickly cool the cargo space 25 prior to receiving or delivering cargo at the destination D1. When the controller 55 determines that the container 20 is in close proximity to the end destination D4 based on the signal from the position detection apparatus 45 and the route data, the control system 35 can initiate the defrost mode of the transport refrigeration system 30 to defrost the evaporator. Generally, the controller 55 can initiate any one of the supercool mode, the normal refrigeration mode, the null mode, the heat mode, the defrost mode, the diagnostic mode, or other operating parameters of the refrigeration system 30 discussed and considered herein prior to the container 20 reaching any potential destination (e.g., destinations D1, D2, D3, D4). The control system 35 initiates various implementation procedures to vary operation of the refrigeration system 30 according to the desired mode or operating parameter of the refrigeration system 30 that is determined by the geographic location and the route data.

If the geographic position of the container 20 relative to the nearest potential destination does not necessitate a change in the operating parameters of the transport refrigeration system 30, the associated implementation procedures associated with the refrigeration system 30 remain the same. In other words, because there is no change in the operating state of the transport refrigeration system 30, there is no need to take action by applying a different implementation procedure. On the other hand, if the control system 35 determines that the geographic position of the container 20 relative to the nearest potential destination necessitates a change in the operating parameter or parameters of the transport refrigeration system 30, the controller 55 alters or initiates the appropriate implementation procedure to effect the change in operation of the transport refrigeration system 30.

Generally, the control system 35 utilizes the geographic position information provided by the position detection apparatus 45 and the route data stored in the database 50 to determine whether the implementation procedures of the transport refrigeration system 30 need to be altered or changed. In other words, the control system 35 determines whether operation of the transport refrigeration system 30 can continue under existing operating parameters, or whether different operating parameters must be implemented based on the geographic position information and the route data.

Figure 2:
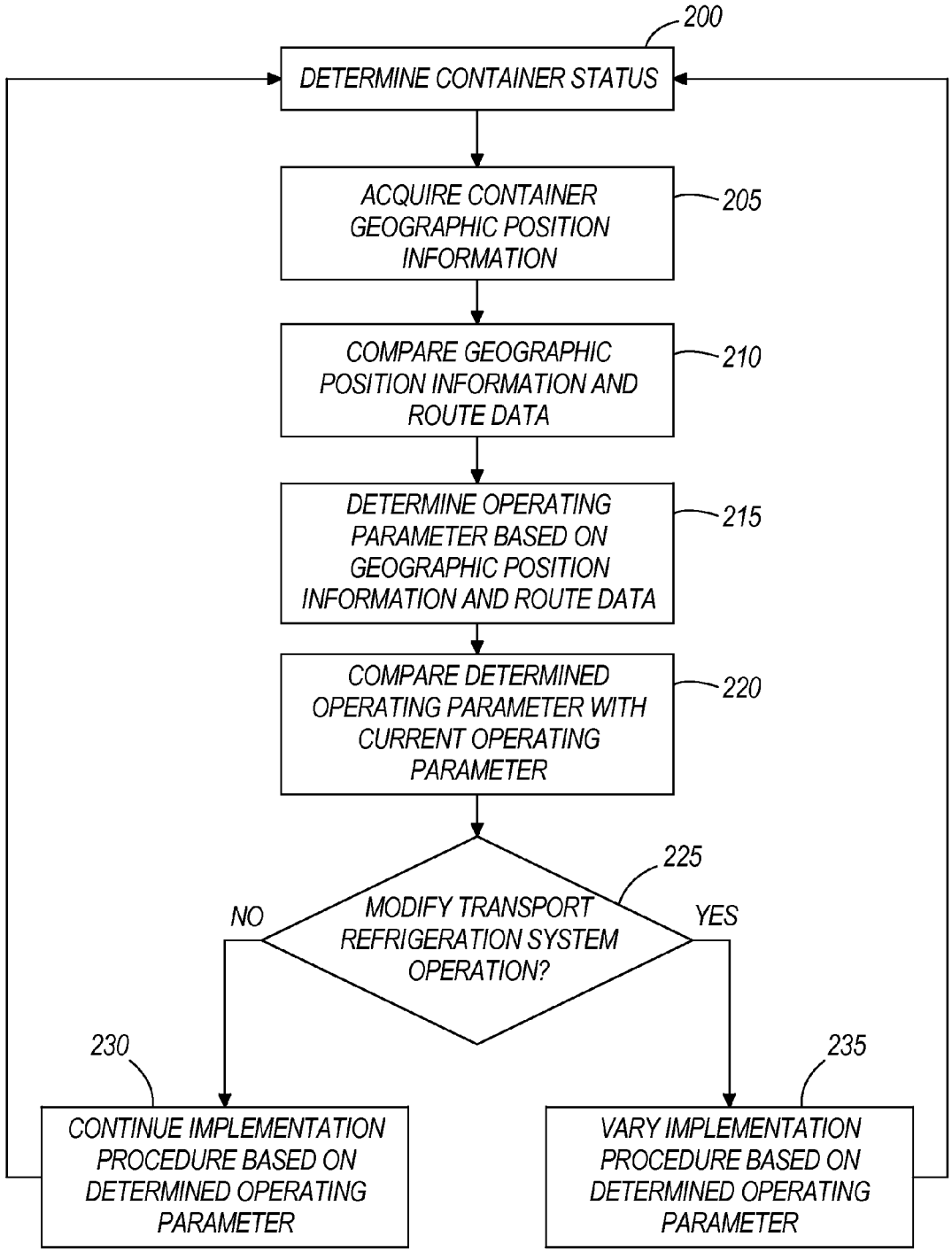
FIG. 2 is a flow chart for controlling the transport refrigeration system.

FIG. 2 shows an exemplary control process of the transport refrigeration system 30 using the control system 35. At step 200, the controller 55 determines whether the container 20 is active or inactive based on the status of the transport refrigeration system 30. In particular, if the transport refrigeration system 30 is OFF (i.e., shutdown), the controller 55 determines that the container 20 is inactive and continues to monitor the container status at step 200. On the other hand, if the transport refrigeration system 30 is ON (i.e., the transport refrigeration system 30 is operating or is in null mode), the controller 55 determines that the container 20 is active and in transit. At step 205, the controller 55 acquires the geographic position information from the position detection apparatus 45 to determine where the container 20 is located. At step 210, the controller 55 compares the geographic position information to the available route data stored in the database 50 to determine the proximity of the container 20 to a destination. In constructions in which the route data includes predetermined destinations, the controller 55 compares the geographic position of the container 20 to the predetermined destinations. In constructions in which the route data includes historical destinations, the controller 55 predicts one or more potential destinations of the container 20 based on the geographic position of the container 20 and the nearest historical destinations.

After the geographic position of the container 20 has been compared to the available route data, the controller 55 then selects an operating parameter for the transport refrigeration system 30 at step 215. In particular, the controller 55 determines the operating parameter of the transport refrigeration system 30 based on the proximity of the container 20 to a predetermined destination or a predicted destination, and initiates the implementation procedure associated with the determined operating parameter to control the refrigeration system 30.

At step 220, the controller 55 compares the determined operating parameter with the current operating parameter of the transport refrigeration system 30. At step 225, the controller 55 determines whether to modify operation of the transport refrigeration system 30 based on the comparison at step 220. Modification of transport refrigeration system 30 operation depends on whether the determined operating parameter is the same as or different from the current operating parameter. If the determined operating parameter is the same as the current operating parameter (i.e., NO at step 225), the control process moves to step 230 and the controller 55 continues to operate the transport refrigeration system 30 based on the current operating parameter by continuing to execute the associated implementation procedure. The control process then returns to step 200.

If the determined operating parameter is different from the current operating parameter (i.e., YES at step 225), the controller 55 has determined that operation of the transport refrigeration system 30 must be modified or changed. At step 235, the controller 55 initiates the appropriate implementation procedure based on the determined operating parameter. The control process then returns to step 200.

The control process is continuous during transit of the container 20 so that updated geographic position information is available to the control system 35 in real-time or near real-time for regulating operation of the transport refrigeration system 30 based on the updated geographic position of the container 20 and the route data. The control system 35 implements the operating parameters of the transport refrigeration system 30 based on the proximity of the container 20 to the potential destinations of the predicted route to maximize efficiency of the transport refrigeration system 30 and to maintain cargo integrity throughout the supply chain. The control system 35 provides predictive conditioning of the cargo space 25 by assigning operating parameters to the proximity of the container 20 relative to a potential destination and by controlling the transport refrigeration system 30 based on the operating parameters. The predictive conditioning also provides accurate control over the conditions of the cargo during transit within the container 20.

The control system 35 can implement a "digital-effect" control or an "analog-effect" control for the refrigeration system 30. With regard to "digital-effect" control (e.g., one-choice control), the control system 35 can operate the transport refrigeration system 30 according to one operating parameter or mode when the container 20 is remote from the predicted or predetermined destination, and according to another operating parameter or mode when the container 20 is in close proximity to the predicted or predetermined destination. In other words, when the container 20 is outside the boundary, the refrigeration system 30 is operated in one mode or according to one operating parameter. When the container 20 is anywhere inside the boundary, the refrigeration system 30 is operated in another mode or according to another operating parameter, regardless of where the container 20 is located relative to the destination. In some constructions, the mode or the operating parameter for the refrigeration system 30 may be the same outside the boundary and inside the boundary.

With regard to "analog-effect" control (e.g., step-wise control or plural-choice control), the control system 35 can operate the transport refrigeration system 30 according to various operating parameters or various modes when the container 20 is remote from the predicted or predetermined destination, and according to other operating parameters or other modes when the container 20 is in close proximity to the predicted or predetermined destination. In other words, when the container 20 is beyond the boundary (i.e., the container 20 is not in close proximity to the destination), the refrigeration system 30 can be substantially continuously varied between different modes or operating parameters based on the remoteness of the container 20 relative to the destination (and therefore the remoteness relative to the boundary). When the container 20 is inside the boundary, the refrigeration system 30 can be substantially continuously varied between different modes or operating parameters based on the relative closeness in proximity of the container 20 to the destination. In some constructions, the modes or the operating parameters for the refrigeration system 30 may be the same outside and inside the boundary.

Various features and advantages of the invention are set forth in the following claims.

The invention claimed is:

1. A transport unit comprising:

a container defining a cargo space for supporting cargo;

position detection apparatus coupled to the container and adapted to determine a geographic location of the container and to generate a signal indicative of the geographic location;

a refrigeration system in communication with the cargo space to condition the cargo space; and a control system including route data defining a plurality of potential destinations of the container, the control system in communication with the position detection apparatus to receive the signal indicative of the geographic location of the container, the control system programmed to predict a route of the container based on the geographic location and the route data, the route defined by at least two potential destinations of the container, the control system further programmed to determine a proximity of the container relative to at least one potential destination of the predicted route, the control system in communication with the refrigeration system to control the refrigeration system based on the proximity of the container relative to the at least one potential destination.

2. The transport unit of claim 1, wherein the potential destinations include a start location, an intermediate destination, and a final destination of the container.

3. The transport unit of claim 2, wherein the control system includes analog-effect control for controlling the refrigeration system.

4. The transport unit of claim 1, wherein the route data includes historical data indicative of the potential destinations of the container.

5. The transport unit of claim 1, wherein the control system is operable to control the refrigeration system in one of a null mode, a defrost mode, a heat mode, a supercool mode, a normal mode, and a diagnostic mode based on the proximity of the container to the at least one potential destination.

6. The transport unit of claim 5, wherein the control system controls the refrigeration system in the supercool mode prior to the container reaching a first potential destination.

7. The transport unit of claim 6, wherein the control system controls the refrigeration system in one of the normal mode and the defrost mode prior to the container reaching a second potential destination.

8. The transport unit of claim 1, wherein the position detection apparatus includes at least two of satellite-based apparatus, antenna-based apparatus, internet-enabled apparatus, and radio frequency apparatus.

9. The transport unit of claim 1, wherein the control system further includes a database associated with the controller and including operating parameters for the transport refrigeration system, and wherein the operating parameters are based on the proximity of the container to the at least one potential destination.

10. The transport unit of claim 9, wherein the database further includes implementation procedures selectable by the controller to control the transport refrigeration system based on the operating parameters.

11. A method of operating a transport unit including a refrigeration system, the method comprising:

supporting cargo in a container of the transport unit;

detecting a geographic location of the container;

generating a signal indicative of the geographic location;

providing route data defining a plurality of potential destinations of the container;

predicting a route of the container based on the geographic location and the route data, the route including at least two potential destinations of the container;

determining a proximity of the container relative to at least one of the potential destinations of the route; and operating the refrigeration system based on the proximity of the container relative to the at least one potential destination.

12. The method of claim 11, wherein predicting the route of the container includes determining destinations of the container from among either or both of predetermined destinations and a plurality of historical destinations.

13. The method of claim 11, further comprising detecting the container in close proximity to the at least one potential destination;

determining an operating parameter of the refrigeration system from among a first operating parameter and a second operating parameter in response to the container being in close proximity to the at least one potential destination; and operating the refrigeration system according to the determined operating parameter.

14. The method of claim 13, further comprising operating the refrigeration system according to the determined operating parameter prior to the container reaching the at least one potential destination.

15. The method of claim 13, further comprising varying the refrigeration system from the first operating parameter to the second parameter in response to the container being in close proximity with the at least one potential destination.

16. The method of claim 11, further comprising operating the refrigeration system according to a first operating parameter in response to the container being remote from the at least one potential destination;

varying the refrigeration system from the first operating parameter to a second operating parameter in response to the container being in close proximity to the at least one potential destination; and operating the refrigeration system according to the second operating parameter prior to the container reaching the at least one potential destination.

17. The method of claim 16, further comprising determining a proximity of the container to a first potential destination;

operating the refrigeration system according to a first operating parameter in response to the container being remote from the first potential destination;

varying the refrigeration system from the first operating parameter to a second operating parameter in response to the container being in close proximity to the first potential destination;

operating the refrigeration system according to the second operating parameter prior to the container reaching the first potential destination;

determining a proximity of the container to a second potential destination;

operating the refrigeration system according to a third operating parameter in response to the container being remote from the second potential destination;

varying the refrigeration system from the third operating parameter to a fourth operating parameter in response to the container being in close proximity to the second potential destination; and operating the refrigeration system according to the fourth operating parameter prior to the container reaching the second potential destination.

18. The method of claim 17, further comprising operating the refrigeration system in a first mode during transport of the container to the first potential destination;

at least one of delivering and receiving cargo relative to the container at the first potential destination;

varying operation of the refrigeration system from the first mode to a second mode different from the first mode; and operating the refrigeration system in the second mode during transport of the container to the second destination.

19. The method of claim 18, wherein operating the refrigeration system in the first mode includes operating the refrigeration system in one of a null mode, a defrost mode, a heat mode, a supercool mode, a normal mode, and a diagnostic mode, and wherein operating the refrigeration system in the second mode includes operating the refrigeration system in another of the null mode, the defrost mode, the heat mode, the supercool mode, the normal mode, and the diagnostic mode.

20. A method of transporting goods along route using a transport unit including a refrigeration system, the method comprising:

detecting a geographic location of a container traveling a route;

generating a signal indicative of the geographic location;

providing route data defining a plurality of potential destinations of the container;

predicting a route of the container based on the geographic location and the route data, the predicted route defined by at least two potential destinations of the container;

determining a proximity of the container relative to a first potential destination of the container;

operating the refrigeration system in a first mode in response to the container being in close proximity to the first potential destination;

at least one of delivering and receiving cargo relative to the container at the first potential destination;

determining a proximity of the container relative to a second potential destination of the container;

operating the refrigeration system in a second mode in response to the container being in close proximity to the second potential destination; and at least one of delivering and receiving cargo relative to the container at the second potential destination.

21. The method of claim 20, wherein predicting the route of the container includes determining the potential destinations of the route from among either or both of predetermined destinations and a plurality of historical destinations.

22. The method of claim 20, further comprising operating the refrigeration system in a third mode in response to the container being remote from the first potential destination prior to the container being in close proximity to the first potential destination, the third mode being different from the first mode.

23. The method of claim 20, wherein operating the refrigeration system in the first mode includes operating the refrigeration system in a supercool mode; and operating the refrigeration system in the second mode includes operating the refrigeration system in one of the supercool mode, a normal mode, a defrost mode, and a diagnostic mode.

24. The method of claim 23, further comprising operating the refrigeration system in the defrost mode in response to the container being in close proximity to the second potential destination.

25. The method of claim 20, further comprising operating the refrigeration system in the first mode and the second mode prior to the container reaching the respective first and second potential destinations.

* * * * *